United States Patent [19]

Heinlein

[11] 4,427,138

[45] Jan. 24, 1984

[54] POURER FOR BOTTLE-LIKE CONTAINERS

[76] Inventor: Hans Heinlein, Dombühlstrasse 33, D-8801 Schillingsfürst, Fed. Rep. of Germany

[21] Appl. No.: 304,040

[22] Filed: Sep. 21, 1981

[30] Foreign Application Priority Data

Sep. 25, 1980 [DE] Fed. Rep. of Germany ..... 3036139

[51] Int. Cl.[3] ..... B65D 47/40

[52] U.S. Cl. ..... 222/546; 222/569; 222/571

[58] Field of Search ..... 222/566, 567, 569, 570, 222/571, 546, 545; 215/227, 307, 358

[56] References Cited

U.S. PATENT DOCUMENTS

| | | | |
|---|---|---|---|
| 212,147 | 2/1879 | Lucas | 222/569 X |
| 2,750,063 | 6/1956 | Opsitnik | 222/571 |
| 3,318,496 | 5/1967 | Ayotte et al. | 222/546 |
| 3,543,973 | 12/1970 | Berins | 222/571 |

FOREIGN PATENT DOCUMENTS

| | | | |
|---|---|---|---|
| 1936026 | 2/1971 | Fed. Rep. of Germany . | |
| 1255197 | 1/1961 | France . | |
| 178184 | 7/1935 | Switzerland | 222/571 |

*Primary Examiner*—Joseph J. Rolla
*Assistant Examiner*—Kevin P. Shaver
*Attorney, Agent, or Firm*—Browdy and Neimark

[57] ABSTRACT

A plastic pourer for insertion into the mouth of a bottle-like container, the pourer including a sealing flange at least partially covering the rim of the bottle mouth and also including a hollow cylindrical wall part bearing against the inside of the mouth. The container is closable with a cap. To insure secure seating of the pourer in the mouth through a large range of tolerances, at least two radically and axially extending feasible holding struts are carried by a hollow inner cylindrical part of the pourer, the struts extending for part of their axial length along the outer periphery of the inner cylindrical part and also beneath the inner cylindrical part. The struts bear elastically against the inner wall of the container mouth with a pressure greater than the holding pressure on a mandrel-like holder carried by the cap for inserting the pourer into the container mouth.

18 Claims, 4 Drawing Figures

POURER FOR BOTTLE-LIKE CONTAINERS

FIELD OF THE INVENTION

The invention relates to a plastic pourer, which is insertable by machine into the mouth of bottle-like containers which can be closed with a cap. The pourer has a sealing flange at least partially covering the rim of the mouth and a hollow-cylindrical wall part resting against the inner wall of the mouth.

BACKGROUND OF THE INVENTION

The introduction of pourers or similar inserts by machine into the mouth of bottle-like containers is known; for instance, such pourers are disposed in a cap and, together with the cap, are applied to a container by a capping machine; or the pourers are introduced into the mouth of the container by an assembling tool. The pourer is intended to be wedged firmly in place in the mouth of the container as the result of elastic forces.

Problems frequently arise because of the fact that the bottle-like containers have particularly great tolerances. If the tolerance is positive, that is, if the inside diameter is larger than the intended dimension, then it is possible for the pourers to stick in the cap. If the tolerances are negative, that is, if the inner diameter of the mouth is smaller than the diameter of the insert, then substantial force must be exerted while introducing the insert into the mouth, with the attendant danger that the threads of the cap will be damaged.

There is also the further danger, in the case of positive tolerance, that when the contents are poured from the container the pourer may float out along with them. If this happens, it must be expected that the user will not reinsert the pourer, and then the required seal between the bottle-like container and the cap once the user has recapped the container will be lacking.

Bottles are also known whose mouth is larger at the top than at some lower point oriented toward the interior of the bottle. Here, again, it is difficult to anchor the pourer or insert in the mouth with sufficient holding power.

SUMMARY OF THE INVENTION

An object of the invention is to overcome deficiencies in the prior art, such as indicated above.

Another object of the invention is the embodiment of a pourer, of the general type described at the outset, such that the pourer is securely anchored in the mouth of the container even over a wide range of tolerances, without requiring the exertion of a closing force greater than that already required for capping the container. The pourer is further intended to be embodied such that it can be used together with other dispensing devices and can be produced in quantity in a simple manner.

In a pourer of the general type described at the outset, these objects are attained in accordance with the invention by providing at least two radially extending, elastic holding struts as well as an inner cylindrical part along which the radially extending holding struts extend for a portion of their axial inner length, while the respective outer edges of the holding struts extend along an elongation of the hollow-cylindrical wall part and rest elastically against the inner wall of the mouth, with a holding pressure which is greater than the holding force exerted on a holder means introducing the pourer into the mouth of the container.

The holder means may efficaciously be embodied in the form of a mandrel and may be part of an assembling tool. In a preferred embodiment, the holder means is arranged in the cap in the form of a cylindrical spigot.

Although in simple cases, two diagonally disposed holding struts suffice, it is advantageous for three holding struts to be arranged in star fashion, with identical angular spacing between them, in accordance with a preferred exemplary embodiment of the invention.

In accordance with a first exemplary embodiment of the invention, the holding struts, with their upper edges, abut the lower edge of the hollow-cylindrical wall part.

In order to connect the pourer with the cap before and during the assembling procedure, it is efficacious for the inner cylindrical part to protrude with a free portion of its jacket into the interior of the hollow-cylindrical wall part.

It is particularly efficacious for the inner cylindrical part to extend approximately as far as the plane of the lower face of the sealing flange which covers the rim of the mouth.

In order to make it easier to introduce the pourer into the mouth of the container and to compensate for any differences in diameter which may exist along the axial length of the mouth, it is advantageous for each holding strut to have a step directed radially inward in the lower rim area of the strut; this step is embodied by a first, oblique edge and an adjacent edge extending approximately axially parallel to the first.

For usage in bottles having a narrowed mouth, it is efficacious for the axial length of the holding struts to be greater than the distance between the narrowed area and the upper rim of the mouth, so that the holding struts overlap the narrowest point, as in a further realization of the invention.

In order to connect the insert with the cap or with an assembling tool, it is advantageous for the inner cylindrical part to be provided with an opening, the inside diameter of which equals the outer diameter of a mandrel of the assembling tool or of the cap.

In accordance with a further embodiment of the invention, the insert may also be used for pouring selectably dispensed quantities of the contents of the container; it is advantageous for a dispensing element to be inserted into the inner cylindrical part in that case.

In accordance with one exemplary embodiment of the invention, the dispensing element is embodied as a drip insert, having a liquid outlet opening, a liquid inlet opening which empties into a cavity in the drip insert, and at least one air inlet opening leading into the container.

In this exemplary embodiment, it is also advantageous that the holding struts, at their upper ends, extend into an annular channel formed by the outer walls of the cylindrical part and by the inside of the hollow-cylindrical wall part.

In a still-further provision of this exemplary embodiment, it is advantageous for the inner face of the inner cylindrical part to have stepped sealing faces which cooperate with complementary sealing faces, embodied for positive engagement, on the outer wall of the drip insert.

For the assembly of an insert comprising a drip insert and a pourer, it is advantageous for the free inside diameter of the liquid outlet opening of the dispensing element to equal the outer diameter of a mandrel of the assembling tool or of the cap.

Simplicity in the manufacture of the pourer according to the invention is attained if the holding struts are embodied in one piece with the inner cylindrical part.

It is particularly advantageous for the pourer, the holding struts and the inner cylindrical part all to be manufactured in one piece with one another.

In accordance with a modified exemplary embodiment of the invention, the sealing flange has an upper annular groove, which cooperates elastically with the assembling tool and/or with an annular protuberance in the inner face of the cap.

Further advantages and details of the invention will be discussed below in greater detail, referring to the drawing, which schematically illustrates exemplary embodiments of the invention.

DESCRIPTION OF THE PREFERRED EMBODIMENTS

Figure 1:
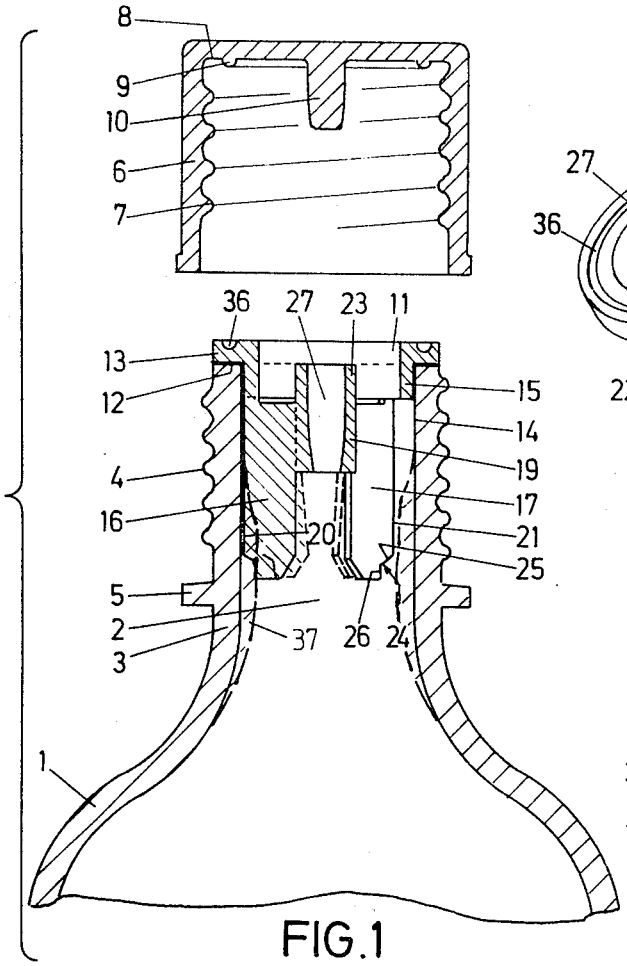
FIG. 1 shows a container, having a cap and an insert according to the invention, in a sectional exploded view.

In FIG. 1, an exemplary embodiment is shown in which a pourer 11 has already been inserted into a mouth 2 of a neck 3 of a container 1, for instance a bottle. The container 1 may have an outer thread 4 as well as a transfer ring 5 on its neck, as shown. A cap 6 having an inner thread 7 and a central spigot or mandrel 10 and/or an annular protuberance 9 on the inside 8 of the base can be connected with the container 1.

The pourer 11 has a sealing flange 13, which at least partially covers a rim 12 of the mouth 2 of the container 1.

The pourer 11 has a hollow-cylindrical wall part 15, which rests against the inside wall 14 of the mouth 2. In accordance with the invention, the pourer 11 is provided with holding struts 16, 17 and 18, which with their outer lengthwise edges 20, 21 and 22, respectively, press against the inside wall 14 of the mouth 2 of the container 1. The holding struts 16, 17 and 18 are connected with an inner cylindrical part 19, being preferably embodied in one piece therewith. A free jacket section 23 of the inner cylindrical part 19 extends into the vicinity of the hollow-cylindrical wall part 15 of the pourer 11, preferably as far as the plane defined by the lower face of the sealing flange 13.

In order to enable easier introduction of the pourer 11 into the mouth 2, the holding struts 16, 17 and 18 are provided with steps 24 on their lower ends; the steps are embodied by an oblique edge 25 and an adjacent, axially parallel edge 26.

In bottles 1 in which there is a constriction 37 (indicated in the drawing by broken lines), the axial length of the holding struts 16, 17 and 18 is selected to be such that the holding struts 16, 17 and 18 overlap the narrowest point 37; in other words, the axial length of the holding struts 16, 17, 18 is greater than the distance from the constriction 37 to the upper rim 12 of the mouth.

It is further provided in FIG. 1 that the sealing flange 13 of the pourer 11 has an upper annular groove 36, which cooperates with the annular protuberance 9 in the cap 6 in such a manner that the pourer 11 is held in place in the cap 6 in a positively engaged, yet elastic manner before the cap 6 is threaded onto the bottle 1. The cap 6 may be provided with grooves or ribs to improve the grip, making removal and replacement of the cap easier for the user. The cap 6 may furthermore have a seal (not shown) as proof of intactness, which may cooperate for example with the transfer ring 5.

Figure 2:
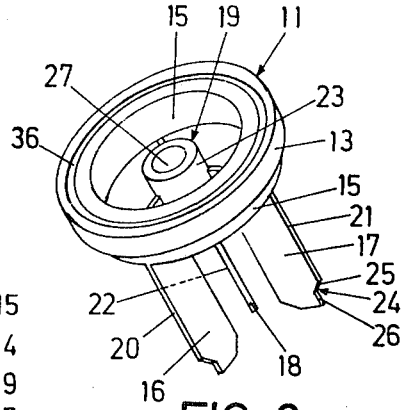
FIG. 2 shows an insert according to the invention, seen obliquely from above.

The construction of a pourer 11 in accordance with the invention may be seen clearly in the oblique perspective view of FIG. 2. In this exemplary embodiment, three holding struts 16, 17, 18 are provided, which are molded onto the inner cylindrical part 19 in the form of a triangle or star, spaced apart by identical angular distances. This construction is selected to be such that the upper edges of the holding struts 16, 17, 18 terminate at the lower edge of the hollow-cylindrical wall part 15. The inner cylindrical part 19 is embodied as a hollow cylinder and it has an opening 27 which passes completely through it. The inside diameter of the opening 27 is selected such that it equals the outer diameter of the mandrel or spigot 10 of the cap 6, so that the pourer 11 is held in the cap 6 in an elastically gripping manner until the capping procedure is finished. The orientation of the holding struts 16, 17, 18 and their outer diameter are selected such that the pressing force exerted against the inner wall 14 of the mouth 2 is greater than the holding force which exists between the inner cylindrical part 19 and the central spigot or mandrel 10 of the cap 6.

Figure 3:
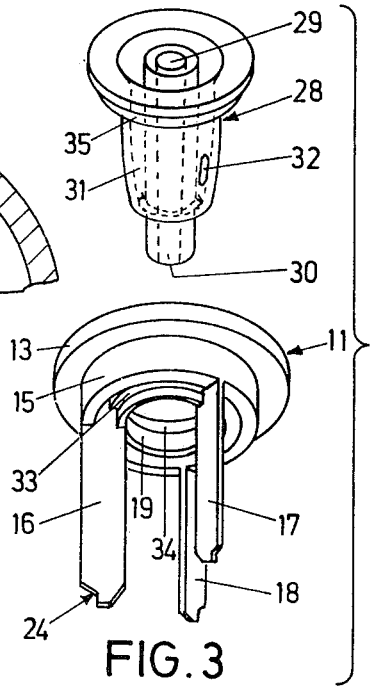
FIG. 3 shows a modified exemplary embodiment seen obliquely from below for use with a drip insert shown exploded therefrom and seen obliquely from above.

In the exemplary embodiment shown in FIG. 3, the construction is selected to be such that a drip insert 28 is insertable into the inner cylindrical part 19. The holding struts 16, 17, 18 here extend into an annular channel 33, which is formed between the outer wall of the inner cylindrical part 19 and the inner wall of the hollow-cylindrical wall part 15. The drip insert 28, in a known manner, has a liquid outlet opening 29 as well as a liquid inlet opening 30 protruding into the container 1. At least one air inlet opening 32 is provided in the wall area 31 of the drip insert 28, establishing communication between the ambient air and the interior of the container. The size of the drops may be determined in accordance with the embodiment of the liquid outlet opening 29.

In order to assure good sealing between the insert 11 and the drip insert 28, a stepped sealing face 34 is efficaciously provided on the inner cylindrical part 19; this sealing face 34 cooperates with a sealing face 35 on the drip insert 28 which is stepped in a complementary manner.

Figure 4:
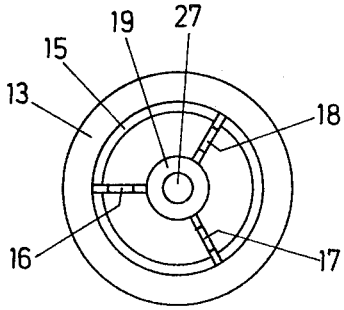
FIG. 4 shows an insert according to FIG. 2, seen from below.

The embodiment and disposition of the individual holding struts 16, 17 and 18 are shown clearly in FIG. 4.

In the exemplary embodiments of FIGS. 2 and 3, the sealing flange 13 having the hollow-cylindrical wall part 15, on the one hand, and the holding struts 16, 17 and 18 and the inner cylindrical part 19 on the other are all maunfactured efficaciously in one piece of an elastic plastic.

As a result of the construction and disposition in accordance with the invention of the holding struts 16, 17 and 18, which are capable of adapting in an elastically yielding manner to tolerances in diameter of the mouth 2, it is assured that there is substantially greater axial contact of parts of the pourer insert 11 in the mouth 2 than would be possible with the hollow-cylindrical wall part 15 alone. Since the lower ends of the holding struts 16, 17 and 18 protrude freely into the mouth 2, they are capable of elastically expanding in the radial direction or, in the case of negative tolerance, of being compressed in a corresponding manner. The necessary adhesive force between the insert 11 and the mouth 2 is assured in every case. The relatively narrow holding struts 16, 17 and 18 present no hindrance either to pouring or, in the case where a drip insert 28 is used, to drop-by-drop dispensing.

Naturally, the pourer 11 according to the invention may also be inserted into containers 1 which do not have a screw thread and are closed instead by an elastic snap top, for instance. In the closed state, the annular protuberance 9 on the inside 8 of the base of the cap 6 is also capable of performing sealing tasks in cooperation with the upper annular groove 36 in the sealing flange 13.

The invention is not restricted to the exemplary embodiments shown and described herein. It also encompasses all modifications and further embodiments within the competence of one skilled in the art as well as partial and subsidiary combinations of the features and provisions described and/or shown herein.

What is claimed is:

1. A plastic pourer insertable into a mouth of a bottle-like container having a rim portion sealable with a cap, said pourer including in an upper portion thereof a first hollow-cylindrical wall part which extends only a portion of the axial height of said pourer, a sealing flange extending from the normally upper end of said hollow-cylindrical wall part and adapted to at least partially cover the rim of said mouth, said first hollow cylindrical wall part having a radially outer wall surface which is adapted to bear against the inner wall of said mouth, an inner hollow cylindrical part carried by said first hollow-cylindrical wall part and of smaller diameter than said first hollow-cylindrical wall part, at least two radially and axially extending elastic holding struts carried by said inner hollow cylindrical part, said holding struts being in circumferentially spaced relation to each other and extending for at least a portion of their axial length along the radially outer surface of said inner hollow-cylindrical part, said holding struts being adapted to bear elastically against the inner wall of the container mouth with a holding pressure which is greater than a holding force exerted between said pourer and a holder means for applying said pourer to the mouth of the container 2. A pourer as defined by claim 1, characterized in that the inner cylindrical part is provided with an opening, the inner diameter of which equals the outer diameter of the holder means of the cap.

3. A pourer as defined by claim 1, characterized in that the holding struts are embodied in one piece with the inner cylindrical part.

4. A pourer as defined by claim 1, characterized in that the pourer, holding struts and inner cylindrical part are all manufactured in one piece.

5. A pourer as defined by claim 1, characterized in that the sealing flange has an upper annular groove, which cooperates elastically with an annular protuberance on the inside face of the cap.

6. A plastic pourer as defined in claim 1, in which said holding struts additionally extend axially in a normally downward direction beneath said inner hollow cylindrical part.

7. A pourer as defined by claim 1, characterized in that the holder means is disposed in the cap in the form of a cylindrical spigot.

8. A pourer as defined by claim 7, characterized in that three holding struts are arranged in star fashion, with identical spacing between them.

9. A pourer as defined by claim 1 or 7, characterized in that each holding strut, on its lower rim area, has a radially inwardly oriented step, which is formed by a first oblique edge and by an adjacent, approximately axially parallel edge.

10. A pourer as defined by claim 7 or 1, intended for use in bottles having a constriction in the mouth thereof to define the most narrow region of said mouth, characterized in that the axial length of said holding struts is such as to cause said struts to overlap said constriction.

11. A pourer as defined by claim 1 or 7, characterized in that the upper edges of the holding struts, abut the lower edge of the hollow-cylindrical wall part.

12. A pourer as defined by claim 1 or 7, characterized in that the inner cylindrical part protrudes with a free jacket portion into the interior of the hollow-cylindrical wall part.

13. A pourer as defined by claim 12, characterized in that the inner cylindrical part extends approximately as far as the plane of the lower sealing face covering the rim of the mouth.

14. A pourer as defined by claim 1, characterized in that a dispensing element is inserted into the inner cylindrical part.

15. A pourer as defined by claim 14, characterized in that the free inside diameter of the liquid outlet opening of the dispensing element equals the outer diameter of a mandrel of the cap.

16. A pourer as defined by claim 14, characterized in that the dispensing element is embodied as a drip insert having a liquid outlet opening, a liquid inlet opening emptying into a cavity of the drip insert and at least one air inlet opening into the container.

17. A pourer as defined by claim 16, characterized in that the holding struts, at their upper ends, extend into an annular channel formed by the outer walls of the inner cylindrical part and by the inside of the hollow-cylindrical part.

18. A pourer as defined by claim 17, characterized in that the inner face of the inner cylindrical part has stepped sealing faces which cooperate with complementary sealing faces, embodied for positive engagement, on the outer wall of the drip insert.

* * * * *